US006499725B2

(12) United States Patent
Meis et al.

(10) Patent No.: US 6,499,725 B2
(45) Date of Patent: Dec. 31, 2002

(54) FENCE RAIL AND POST ASSEMBLY

(76) Inventors: William J. Meis, 23590 Old Lincoln Hwy., Crescent, IA (US) 51526; Robert W. Yard, 17111 Limekiln Rd., Crescent, IA (US) 51526

( * ) Notice: Subject to any disclaimer, the term of this patent is extended or adjusted under 35 U.S.C. 154(b) by 19 days.

(21) Appl. No.: 09/729,511

(22) Filed: Dec. 4, 2000

(65) Prior Publication Data

US 2002/0066897 A1 Jun. 6, 2002

(51) Int. Cl.[7] ..... F16B 7/08
(52) U.S. Cl. ..... 256/65.03; 256/68
(58) Field of Search ..... 256/65, 19, 68, 256/65.01, 65.02, 65.03, 65.04; 245/59

(56) References Cited

U.S. PATENT DOCUMENTS

| | | | | |
|---|---|---|---|---|
| 11,315 A | | 7/1854 | Walker, Sr. | |
| 194,724 A | | 8/1877 | Reed et al. | |
| 346,644 A | | 8/1886 | Crisp | |
| 438,987 A | | 10/1890 | Coffman | |
| 444,960 A | | 1/1891 | Priday | |
| 1,954,256 A | | 4/1933 | Nelson | |
| 4,063,836 A | * | 12/1977 | Militano | 256/65 X |
| 4,360,285 A | * | 11/1982 | Magness | 256/65 X |
| 4,369,953 A | * | 1/1983 | Greiner et al. | 256/65 X |
| 4,883,256 A | | 11/1989 | Hebda | |
| 5,161,783 A | | 11/1992 | German | |

FOREIGN PATENT DOCUMENTS

| | | | | |
|---|---|---|---|---|
| FR | 1020106 | * | 2/1953 | 256/65.04 |

* cited by examiner

*Primary Examiner*—Lynne H. Browne
*Assistant Examiner*—John Cottingham

(57) ABSTRACT

A fence rail and post construction is described wherein a metal tubular fence rail has one end thereof extending through an opening formed in one side of the post. A rail retainer is selectively removably secured to the fence rail outwardly of the post with the retainer engaging the post to limit longitudinal movement of the fence rail with respect to the post.

12 Claims, 5 Drawing Sheets

FENCE RAIL AND POST ASSEMBLY

BACKGROUND OF THE INVENTION

1. Field of the Invention

This invention relates to a fence rail and post assembly and more particularly to an assembly wherein the fence rails and posts are comprised of a tubular metal material. More particularly, the invention relates to a means of connecting the fence rails to the post or posts.

2. Description of the Related Art

Many types of fences have been used to enclose land, mark boundaries, keep in animals, ensure privacy, or add a decorative touch to homes. In farm areas, fences protect valuable crops from destruction by roaming animals. Perhaps the earliest type of fences which were utilized were stone fences created by simply piling stones one on top of another. Wire is also used in many ways to make fences. For example, types of wire fences which have been used are barbed wire, wire mesh and electrified fences. Brush or deadwood formed the earliest type of fences which were simply brush and tree limbs cleared from the land and piled up to make an obstacle. Perhaps one of the most popular fences presently in use is the post and rail fence assembly wherein posts are placed at intervals and which support horizontal rails. A recent trend has been to utilize PVC posts and rails. The same, although decorative, sometimes lack the strength to resist forces imposed thereon by animals or the like. In an effort to provide stronger post and rail fences, metal tubular rails have been welded to metal posts. Such construction, although extremely strong, is quite costly and is labor-intensive. Further, once the rails have been welded to the posts, it is difficult to replace or repair the fences.

SUMMARY OF THE INVENTION

A fence rail and post assembly is described and includes a hollow tubular metal post having its lower end positioned in the ground and which has first, second, third, and fourth side walls. Depending upon the fence layout and the position of the post in that layout, at least one side thereof will have at least one, and normally two or three, openings formed therein which are adapted to receive one end of a metal tubular fence rail. A rail retainer is selectively removably secured to the fence rail outwardly of the post and which is maintained in position by a screw extending therethrough into the fence rail. The rail retainer has a shoulder provided thereon which engages the exterior surface of the post adjacent the opening and has a hook at its inner end which engages the interior surface of the side wall in which the opening is formed. The rail retainer permits longitudinal movement of the fence rail with respect to the post. The rail retainers may be positioned on top of the rails for convenience of installation, or positioned on the bottom of the rails for aesthetic purposes.

It is therefore a principal object of the invention to provide an improved fence rail and post assembly.

A further object of the invention is to provide an improved metal fence rail and post assembly.

Yet another object of the invention is to provide a fence rail and post assembly wherein the end of the fence rail is maintained in the post by means of a rail retainer which limits longitudinal movement of the fence rail with respect to the post.

A further object of the invention is to provide a metal fence rail and post assembly which is extremely strong and which is easily assembled.

These and other objects will be apparent to those skilled in the art.

DESCRIPTION OF THE PREFERRED EMBODIMENT

Figure 1:
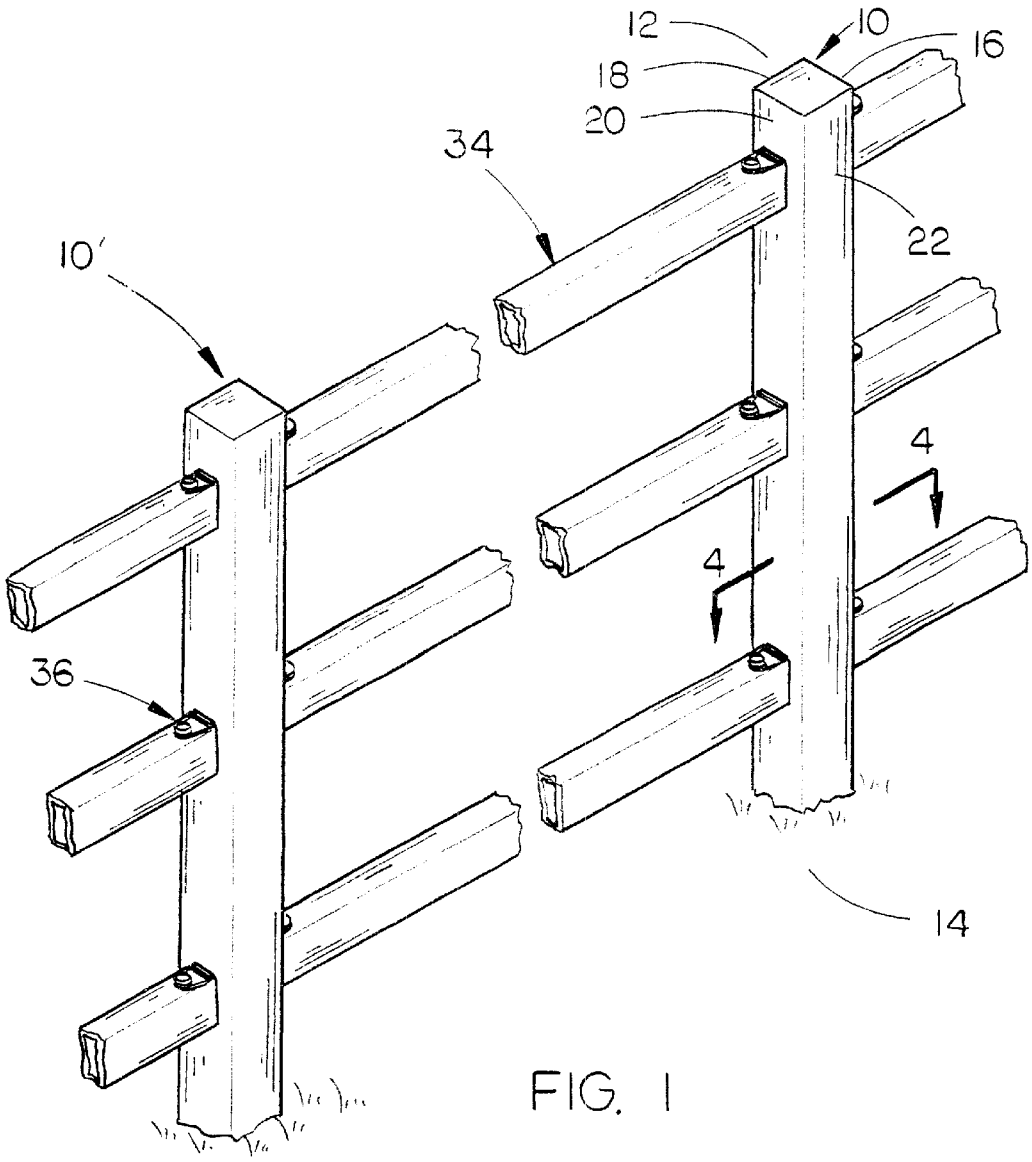
FIG. 1 is a partial view of the fence rail and post assembly of this invention.

In the drawings, the numerals 10 and 10' refer to a pair of metal, such as steel, fence posts forming a post of a fence. The fence posts 10 and 10' could be line posts, a corner post and line post, or a gate post. For purposes of description, post 10 will be described as having an upper end 12 and a lower end 14 which is embedded in the ground. Post 10 is hollow or tubular and comprises side walls 16, 18, 20 and 22. Each of the side walls 16, 18, 20 and 11 obviously have interior and exterior surfaces.

If the post 10 is to be used as a line post, at least one, and normally two or three, vertically spaced openings 24 will be formed in each of side walls 16 and 20. If post 10 is to serve as a corner post, the openings 24 will be formed in one of the side walls 16 or 20 and will be formed in one of the side walls 18 or 22, depending upon the fence layout. If post 10 is being used as a gate post, the openings 24 will be formed in the side wall which is opposite to the hinge side of the post or will be formed in one of the side walls adjacent the hinge side of the post, depending on the fence layout. In any event, the means of attaching the fence rail to the fence post is the object of this invention, regardless of which side wall of the post has the openings formed therein. For purposes of description, opening 24 will be described as having an upper end 26, lower end 28, and opposite sides 30 and 32.

An elongated, metal, tubular fence rail 34 is extended between the posts 10 and 10' with the opposite side ends thereof being received by aligned openings 24. Normally, the height dimension of the opening 24 will be slightly larger than the height dimension of the fence rail 34 to permit the end of the fence rail 34 to be easily inserted thereinto and to insert the rail retainer 36, as will be described hereinafter.

Normally, the fence posts 10 and 10' are in their fixed position prior to the rails 34 being secured thereto. One end of the rail 34 is inserted into opening 24 of fence post 10 until the other end of the fence rail is spaced inwardly of post 10'. The rail 34 is then moved longitudinally so that the other end of rail 34 is received by the proper opening 24 in post 10'. When the rail 34 has been approximately centered between the posts 10 and 10', a metal rail retainer 36 is secured to each of the ends of the rail 34 to limit longitudinal movement of the rail 34 with respect to the posts 10 and 10'. Although it is preferred that the retainers 36 limit longitudinal movement of rail 34 away from post 10 and towards post 10, there may exist some situations wherein it is necessary to limit the movement in a single direction.

Figure 2:
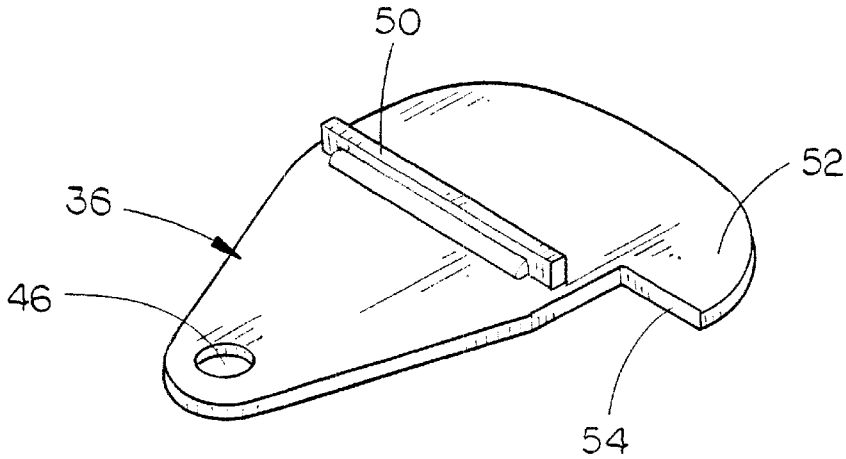
FIG. 2 is a perspective view of one of the rail retainers.
Figure 3:
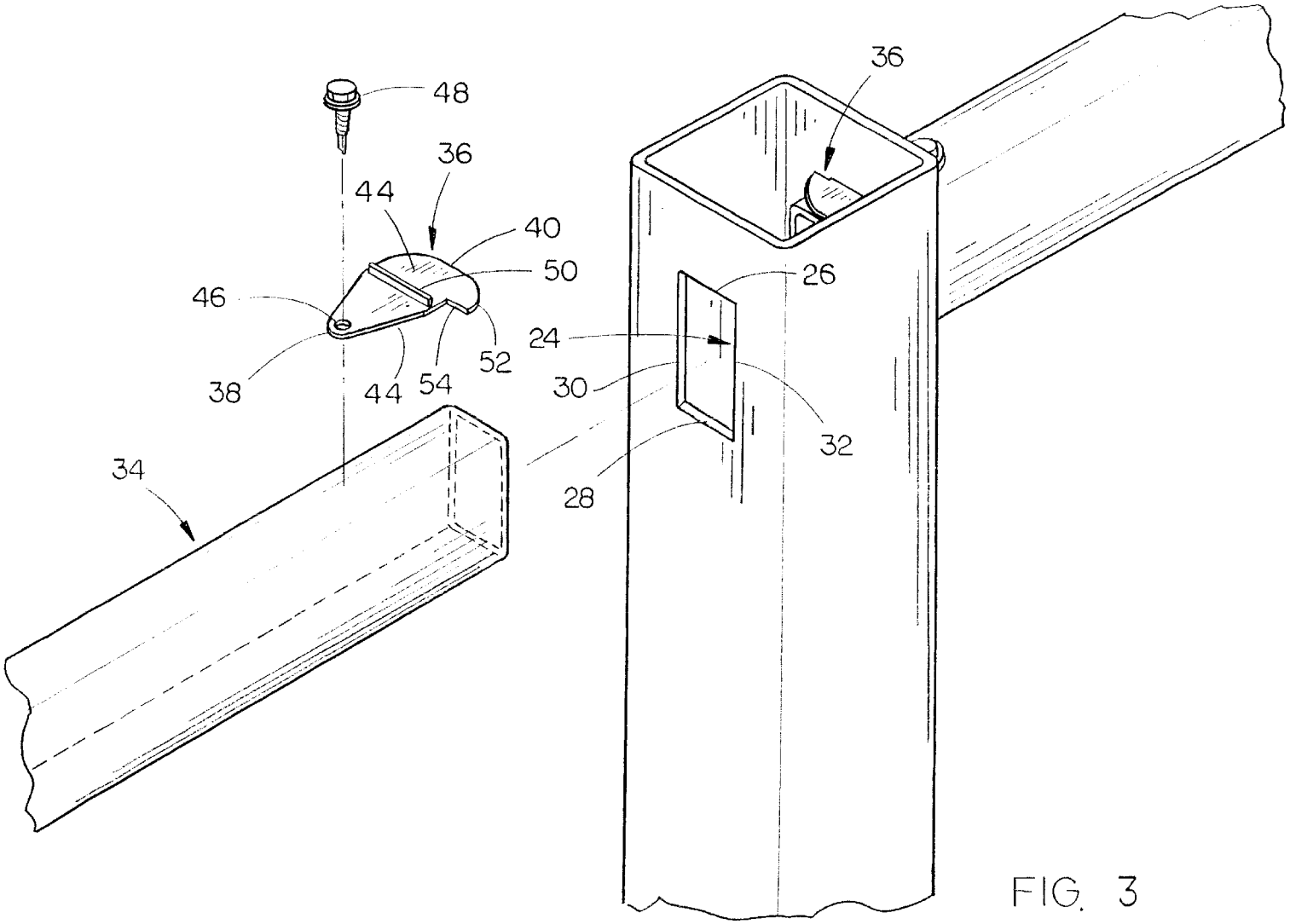
FIG. 3 is an exploded perspective view illustrating the means by which the rails are secured to the posts.
Figure 6:
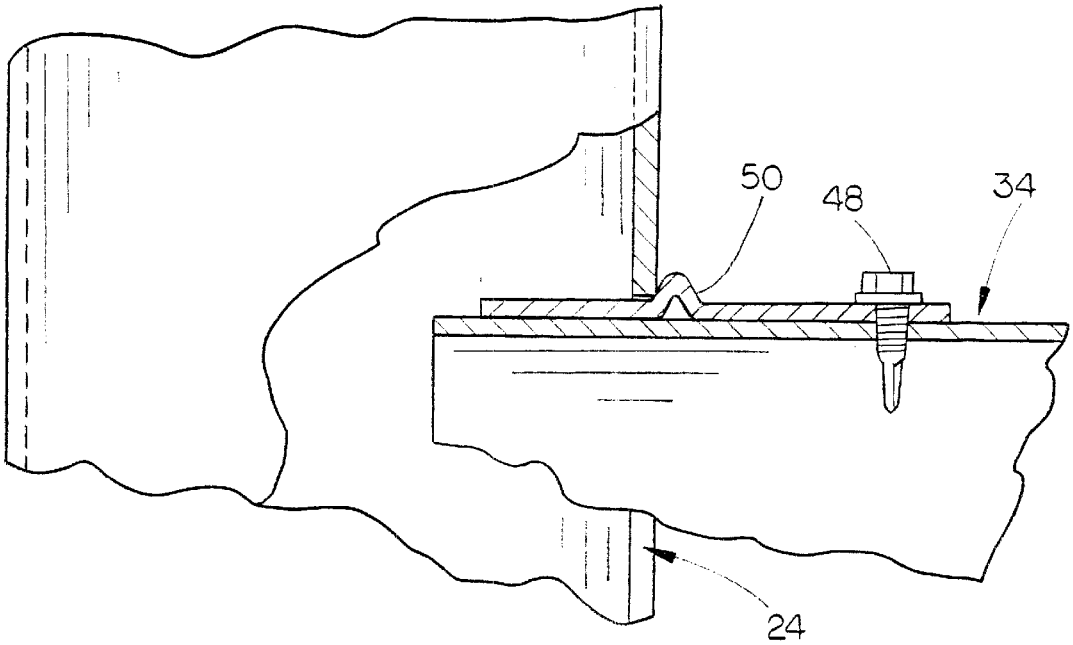
FIG. 6 is a view similar to FIG. 5 except that the rail retainer has a somewhat different shape than the rail retainer of FIG. 5.
Figure 5:
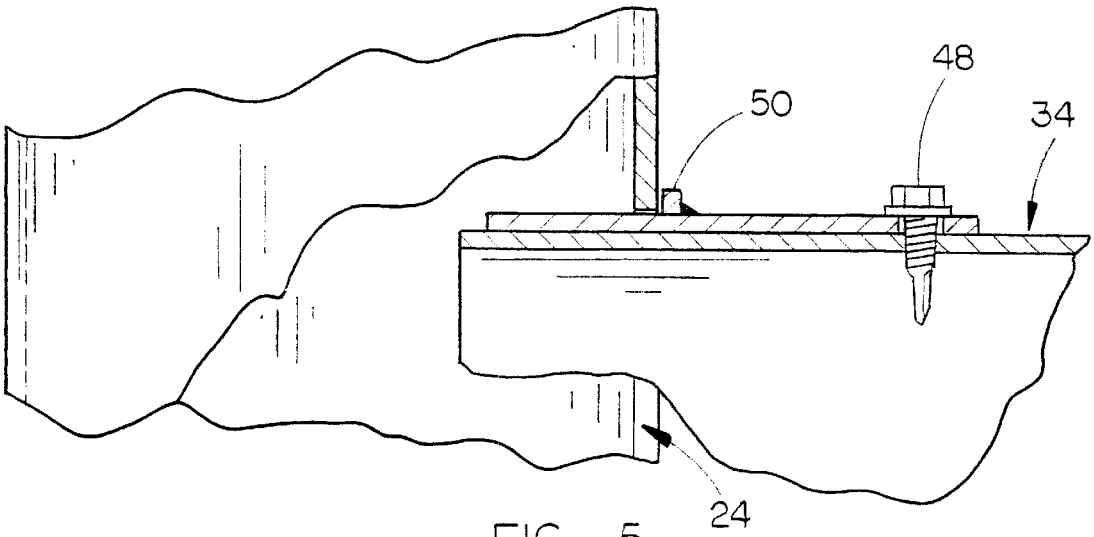
FIG. 5 is a side view of one form of the rail retainer and its position on the rail with portions of the rail and post being cut away to more fully illustrate the invention.

Retainer 36 includes an outer end 38, inner end 40, a top surface 42 and a lower surface 44. Retainer 36 is provided with an opening 46 formed therein adjacent its outer end 38 for receiving a self-tapping screw 48 therein. Retainer 36 is provided with a protruding shoulder 50 which extends upwardly therefrom. Shoulder 50 could be welded on the retainer, as seen in FIGS. 2 and 5, or could be formed by bending, as seen in FIG. 6. A laterally extending hook 52 is provided at the inner end of retainer 36 which defines a shoulder 54.

Figure 4:
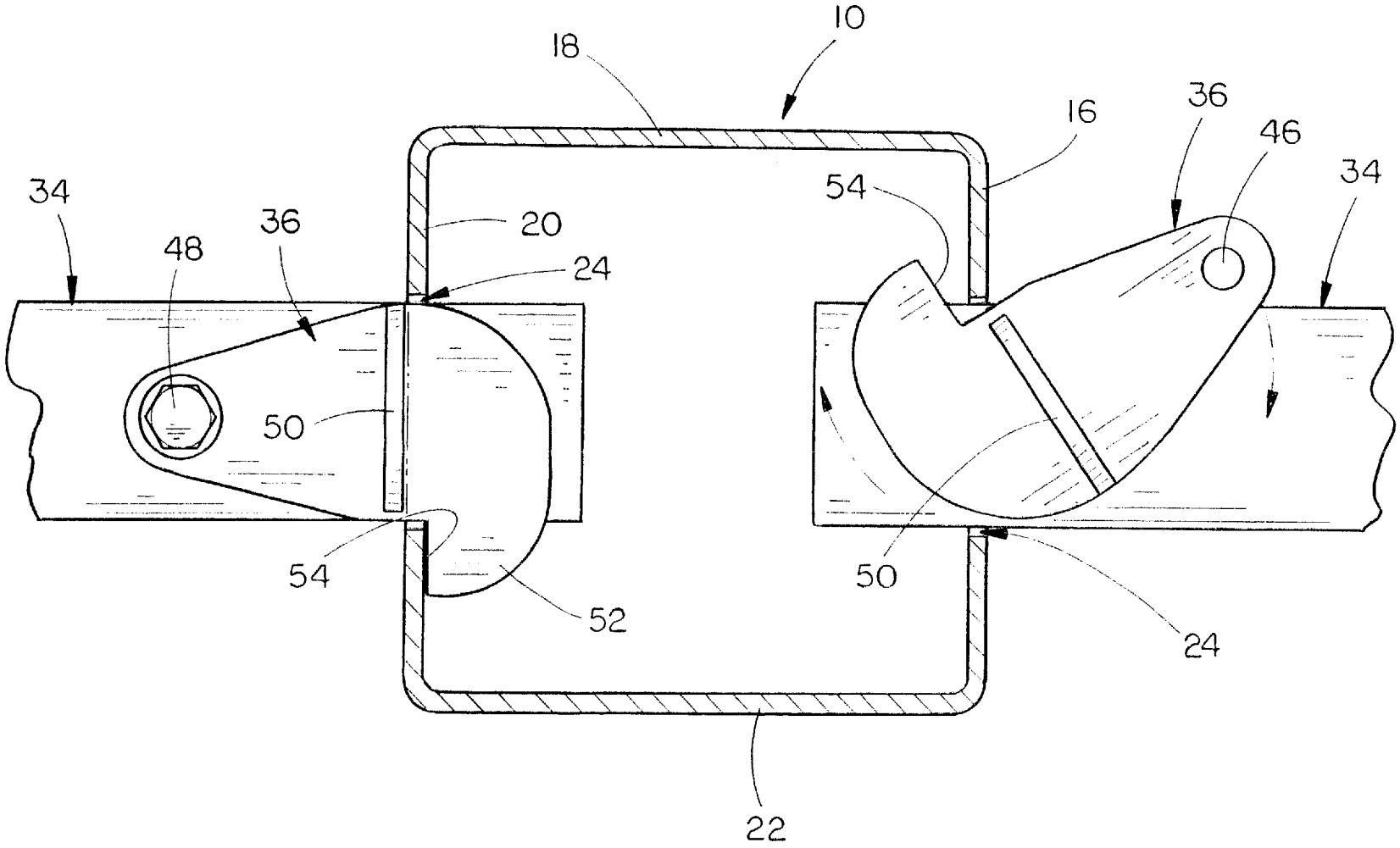
FIG. 4 is an enlarged sectional view as seen on lines 4–4 of FIG. 1.

The retainer 36 is secured to each end of the fence rail 34 as follows. After the ends of rail 34 have been inserted into the appropriate openings 24 and properly positioned with respect to the posts 10 and 10', the inner end of the retainer 36 is inserted into the opening 24 between the top wall of rail 34 and the upper end of the opening 24 in a clockwise direction, as viewed in FIG. 4. When the inner end of retainer 36 has been inserted into opening 24 so that hook 52 is positioned inwardly of the interior surface of the wall 16, the retainer 36 is maneuvered until shoulder 54 is positioned in engagement with, or in close proximity to, the interior surface of wall 16 laterally of the opening 24 and shoulder 50 is in engagement with, or in close proximity to, the exterior surface of wall 16 (FIG. 4). The self-tapping screw 48 is then inserted into the opening 46 and rotated to cause the screw 48 to screw itself into the top wall of the rail 34. This procedure is repeated until all the fence rails 34 have been secured to the posts 10 and 10'.

The retainers 36 at each end of the rail 34 limit the longitudinal movement of rail 34 with respect to the posts 10 and 10'. Further, if one of the posts is struck by a vehicle or animal, movement of the post will not cause the separation of the post from the rails 34.

Although the description above has described the retainer 36 as being secured to the top wall of the rail 34, the retainer could be mounted on bottom walls of the rail 34 if so desired. The retainers 34 are more easily installed on the top of the rails 34, but the fence is more pleasing aesthetically when installed on the underside of the rails 34.

Figure 7:
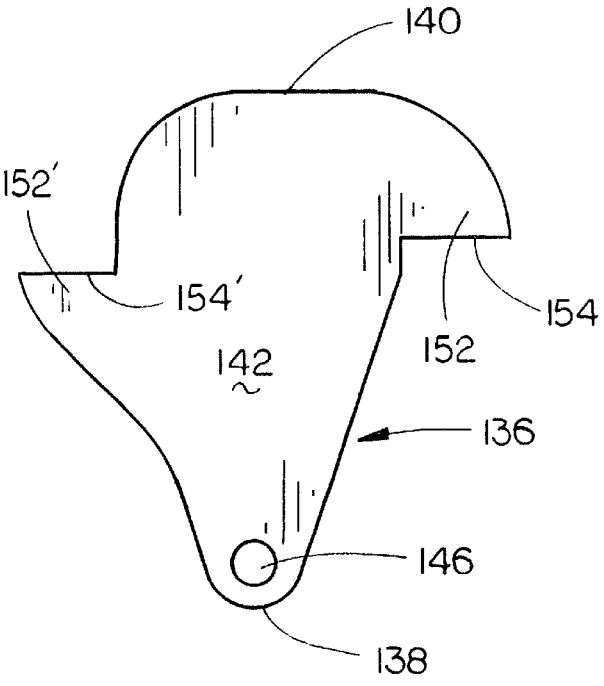
FIG. 7 is a plan view of a modified form of the retainer.
Figure 8:
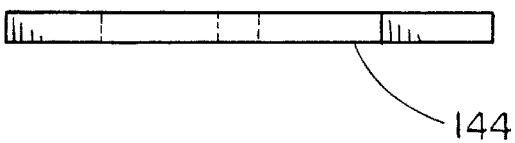
FIG. 8 is an end elevational view of the embodiment of FIG. 7.

FIGS. 7 and 8 illustrate a modified version of the metal rail retainer and which is referred to generally by the reference numeral 136. Retainer 136 is essentially identical to retainer 36 except that it does not have a shoulder on the upper surface thereof.

Retainer 136 includes an outer end 138, inner end 140, a top surface 142 and a lower surface 144. Retainer 136 is provided with an opening 146 formed therein adjacent its outer end 138 for receiving a self-tapping screw therein. A laterally extending hook 152 is provided at the inner end of retainer 136 which defines a shoulder 154. A laterally extending hook 152' is provided at the inner end of retainer 136 which defines a shoulder 154'. As seen in FIG. 7, the hooks 152 and 152' are disposed oppositely to one another.

The retainer 136 is secured to each end of the fence rail 34 as follows. After the ends of rail 34 have been inserted into the appropriate openings 24 and properly positioned with respect to the posts 10 and 10', hook 152 is inserted into the opening 24 between the top wall of rail 34 and the upper end of the opening 24 in a clockwise direction until shoulder 154' engages the exterior surface of the post. The retainer 136 is also maneuvered until shoulder 154 is positioned in engagement with, or in close proximity to, the interior surface of wall 16 laterally of the opening 24. A self-tapping screw is then inserted into the opening 146 and rotated to cause the screw to screw itself into the top wall of the rail 34. This procedure is repeated until all the fence rails 34 have been secured to the posts 10 and 10'.

Figure 9:
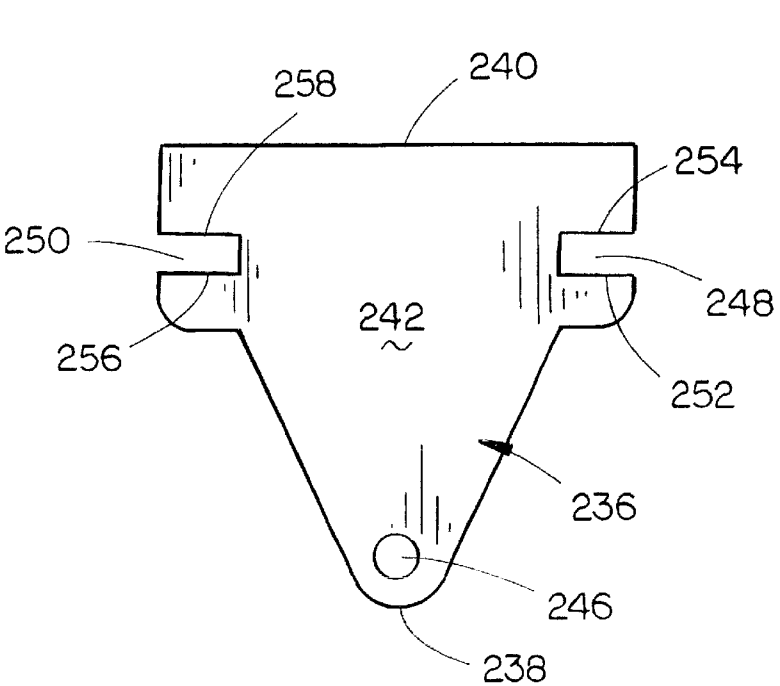
FIG. 9 is a plan view of yet another modified form of the retainer.
Figure 10:
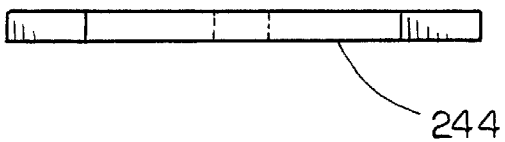
FIG. 10 is an end elevational view of the embodiment of FIG. 9.

FIGS. 9 and 10 illustrate yet another embodiment of the rail retainer and which is referred to generally by the reference numeral 236. Retainer 236 includes an outer end 238, an inner end 240, a top surface 242 and a lower surface 244. Retainer 236 is provided with an opening 246 formed therein adjacent its outer end 238 for receiving a self-tapping screw therein. Retainer 236 is provided with notches 248 and 250 formed in the sides thereof, as seen in FIG. 9. Notch 248 defines shoulders 252 and 254 while notch 250 defines shoulders 256 and 258.

The retainer 236 is secured to each end of the fence rail 34 as follows. The retainer 236 is inserted into the opening 24 between the top wall of rail 34 and the upper end of the opening 24 so that notch 248 receives wall 16 positioned laterally of the opening 24. The retainer 236 is then maneuvered so that notch 250 receives the wall 16 of the post 10 at the other side of the opening 24. When the retainer 236 has been properly positioned, and the self-tapping screw inserted through the opening 246, the shoulders 252, 254, 256 and 258 prevent longitudinal movement of the rail with respect to the post.

Thus it can been seen that the invention accomplishes at least all of its stated objectives.

We claim:

1. A fence rail and post assembly, comprising:

a hollow tubular metal post having a lower end positioned in the ground having first, second, third, and fourth side walls;

each of said side walls having an interior surface and an exterior surface;

a metal, tubular fence rail having opposite ends, a top wall, a bottom wall, a front wall, and a back wall;

said fence rail having an exterior surface;

at least one of said side walls of said post having at least one opening formed therein for receiving one end of the fence rail therein;

and a rail retainer positioned on said exterior surface of said fence rail and being selectively removably secured to said fence rail outwardly of said post which engages said post to limit longitudinal movement of said fence rail with respect to said post.

2. The fence rail and post assembly of claim 1 wherein said rail retainer limits longitudinal movement of said fence rail towards said post.

3. The fence rail and post assembly of claim 1 wherein said rail retainer limits longitudinal movement of said fence rail away from said post.

4. The fence rail and post assembly of claim 2 wherein said rail retainer also limits longitudinal movement of said fence rail away from said post.

5. The fence rail and post assembly of claim 1 wherein said rail retainer is secured to one of said top and bottom walls of said fence rail.

6. The fence rail and post assembly of claim 1 wherein said rail retainer has inner and outer ends and wherein said rail retainer has a laterally extending hook at its inner end which defines a shoulder which engages the interior surface of the side wall in which said opening is formed.

7. The fence rail and post assembly of claim 1 wherein said rail retainer is metal.

8. The fence rail and post assembly of claim 1 wherein said rail retainer has inner and outer ends and wherein said rail retainer has a pair of laterally extending, opposing hooks at its inner end defining shoulders, one of said shoulders engaging the interior surface of the side wall in which said opening is formed and the other of which engages the exterior surface of the side wall in which said opening is formed.

9. The fence rail and post assembly of claim 1 wherein said rail retainer has inner and outer ends and first and second side edges and wherein each of said edges has a notch formed therein for receiving portions of said wall therein in which said opening is formed.

10. A fence rail and post assembly, comprising:

a hollow tubular metal post having a lower end positioned in the ground having first, second, third, and fourth side walls;

each of said side walls having an interior surface and an exterior surface;

a metal, tubular fence rail having opposite ends, a top wall, a bottom wall, a front wall, and a back wall;

at least one of said side walls of said post having at least one opening formed therein for receiving one end of the fence rail therein;

and a rail retainer selectively removably secured to said fence rail outwardly of said post which engages said post to limit longitudinal movement of said fence rail with respect to said post;

said rail retainer being screwed to said fence rail.

11. A fence rail and post assembly, comprising:

a hollow tubular metal post having a lower end positioned in the ground having first, second, third, and fourth side walls;

each of said side walls having an interior surface and an exterior surface;

a metal, tubular fence rail having opposite ends, a top wall, a bottom wall, a front wall, and a back wall;

at least one of said side walls of said post having at least one opening formed therein for receiving one end of the fence rail therein;

and a rail retainer selectively removably secured to said fence rail outwardly of said post which engages said post to limit longitudinal movement of said fence rail with respect to said post;

said rail retainer having a protruding shoulder which engages the exterior surface of said post adjacent said opening.

12. A fence rail and post assembly, comprising:

a hollow tubular metal post having a lower end positioned in the ground having first, second, third, and fourth side walls;

each of said side walls having an interior surface and an exterior surface;

a metal, tubular fence rail having opposite ends, a top wall, a bottom wall, a front wall, and a back wall;

at least one of said side walls of said post having at least one opening formed therein for receiving one end of the fence rail therein;

and a rail retainer selectively removably secured to said fence rail outwardly of said post which engages said post to limit longitudinal movement of said fence rail with respect to said post;

said rail retainer being secured to said fence rail by a self-tapping screw.

* * * * *